US006676085B1

(12) United States Patent
Chang

(10) Patent No.: US 6,676,085 B1
(45) Date of Patent: Jan. 13, 2004

(54) KITE

(76) Inventor: Chin-Chuan Chang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/195,507

(22) Filed: Jul. 12, 2002

(51) Int. Cl.[7] ..... A63H 27/08; A63H 27/00
(52) U.S. Cl. ..... 244/153 R; 244/154
(58) Field of Search ..... 244/153 R, 154, 244/155, 155 A

(56) References Cited

U.S. PATENT DOCUMENTS

| | | | | | |
|---|---|---|---|---|---|
| 76,028 | A | * | 3/1868 | Yorns | 244/153 R |
| 997,455 | A | * | 7/1911 | Lischtiak | 244/153 R |
| 2,257,298 | A | * | 9/1941 | Hahn | 244/154 |
| 2,394,366 | A | * | 2/1946 | Chu et al. | 244/153 R |
| 2,508,747 | A | * | 5/1950 | Cox | 244/153 R |

FOREIGN PATENT DOCUMENTS

| | | | | |
|---|---|---|---|---|
| JP | 5079878 | * | 6/1975 | A63H/27/08 |

* cited by examiner

*Primary Examiner*—Charles T. Jordan
*Assistant Examiner*—Stephen A Holzen

(57) ABSTRACT

A kite has a support frame and a waterproof fabric covering the support frame. The support frame has a levelling rod, a center spine passing through the levelling rod, a head rod disposed on a front of the center spine, a hollow joint disposed on the center spine, a first front rod and a second front rod connected to the hollow joint, a first positioning block disposed on the hollow joint, a second positioning block disposed on the hollow joint, a first connector disposed on the first front rod, a second connector disposed on the second front rod, a first extended bar connected to the first connector, a second extended bar connected to the second connector, a first connection rod connected to the second extended bar and the first front rod, and a second connection rod connected to the first extended bar and the second front rod.

2 Claims, 5 Drawing Sheets

KITE

BACKGROUND OF THE INVENTION

The present invention relates to a kite. More particularly, the present invention relates to a kite which can be detached and assembled easily.

A conventional kite has a spine adhered on a cover sheet. It is cumbersome to adhere the spine and the cover sheet together.

SUMMARY OF THE INVENTION

An object of the present invention is to provide a kite which is easily assembled.

Another object of the present invention is to provide a kite which is easily detached.

Accordingly, a kite comprises a waterproof fabric and a support frame. The support frame has a levelling rod, a center spine passing through the levelling rod, a head rod disposed on a front of the center spine, a hollow joint disposed on the center spine, a first front rod connected to the hollow joint, a second front rod connected to the hollow joint, a first positioning block disposed on the hollow joint to position the first front rod, a second positioning block disposed on the hollow joint to position the second front rod, a first connector disposed on the first front rod, a second connector disposed on the second front rod, a first extended bar connected to the first connector, a second extended bar connected to the second connector, a first connection rod connected to the second extended bar and the first front rod, a second connection rod connected to the first extended bar and the second front rod, the second extended bar intersecting the first extended bar, and the levelling rod disposed between the first connection rod and the second connection rod. The waterproof fabric has a head portion covering the head rod, a first wing portion supported by the first front rod and the first connection rod, a second wing portion supported by the second front rod and the second connection rod, and a tail portion supported by the first extended bar and the second extended bar.

DETAILED DESCRIPTION OF THE INVENTION

Figure 1:
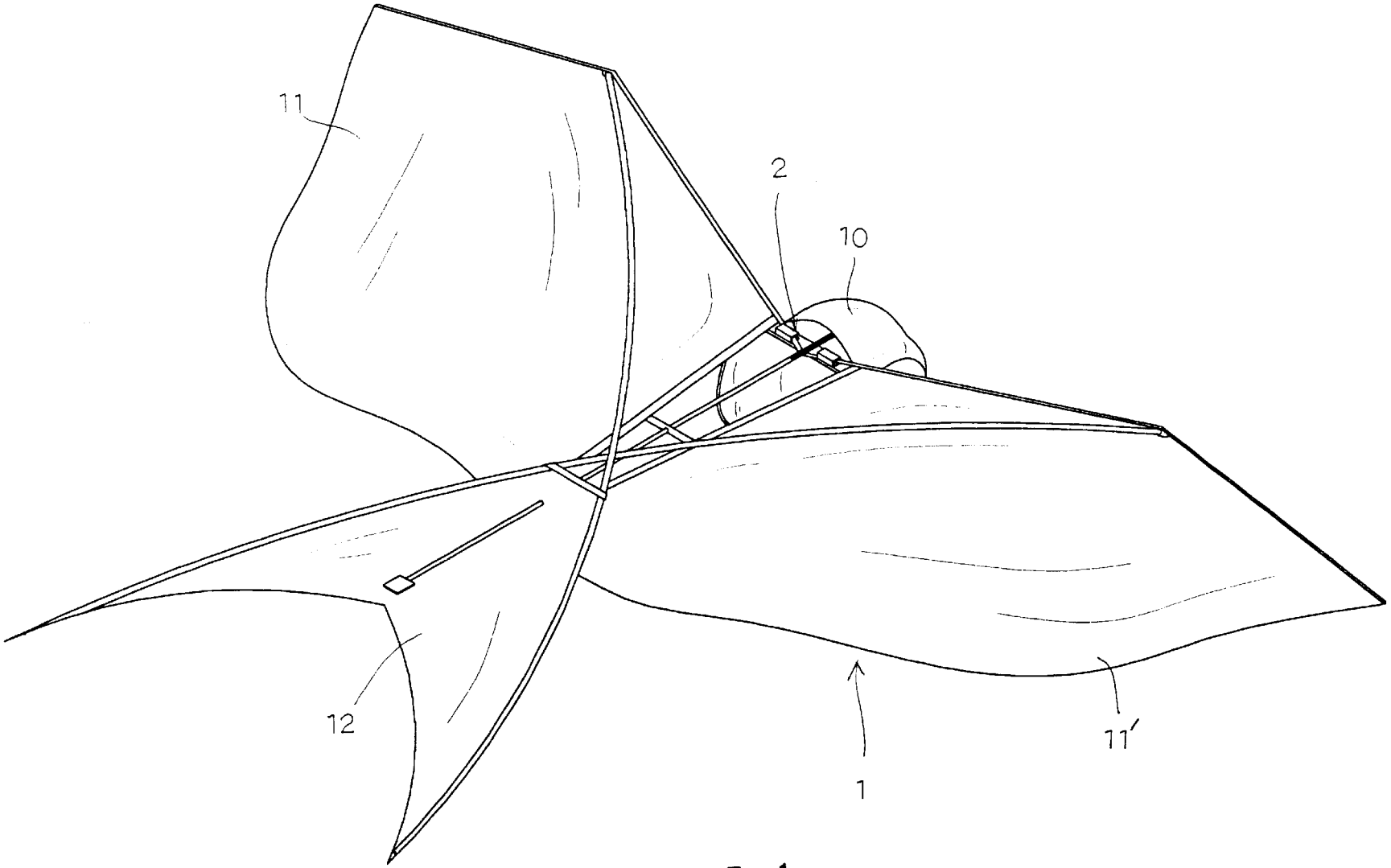
FIG. 1 is a perspective view of a kite of a preferred embodiment in accordance with the present invention.
Figure 2:
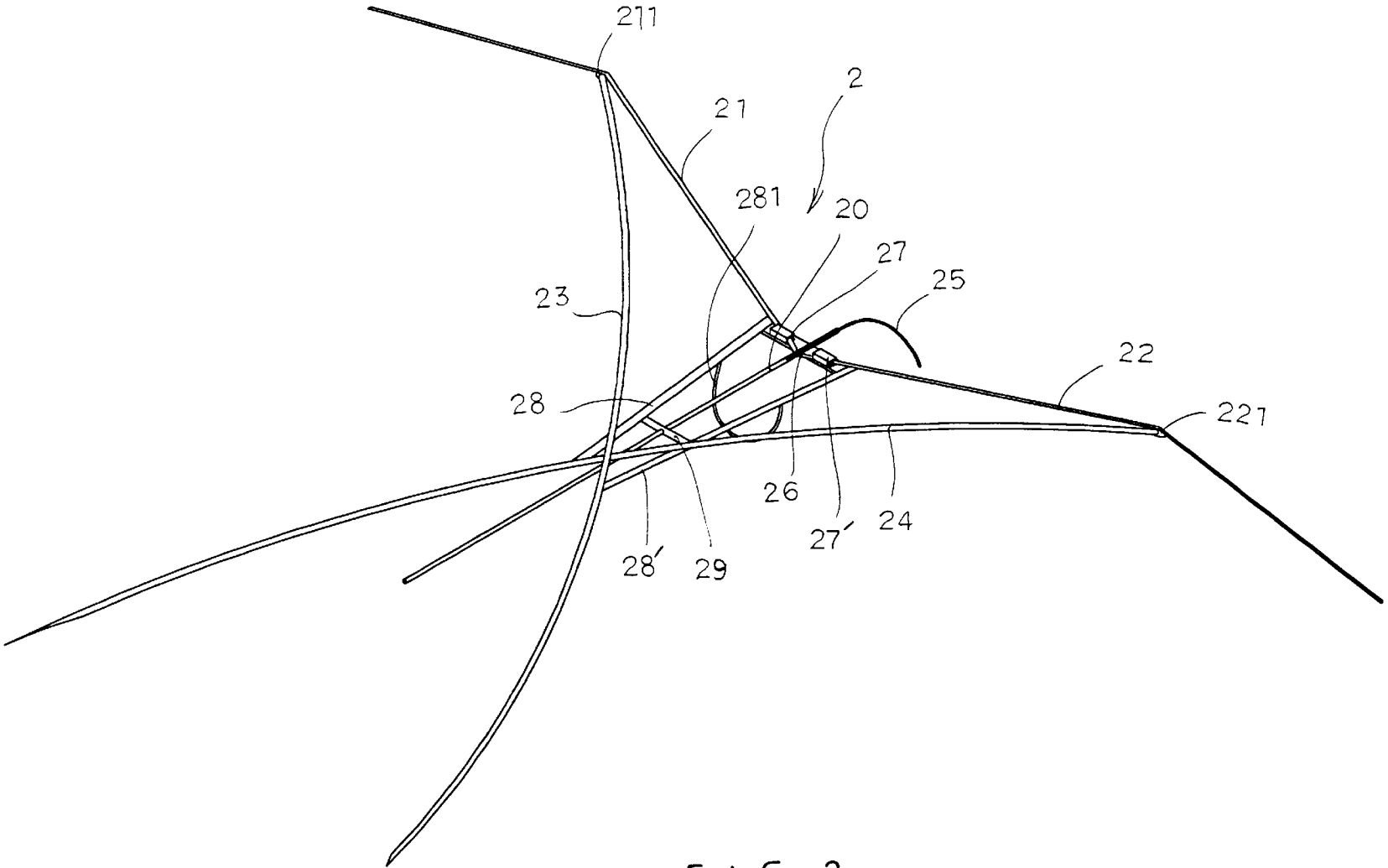
FIG. 2 is a perspective view of a support frame of a preferred embodiment in accordance with the present invention.
Figure 3:
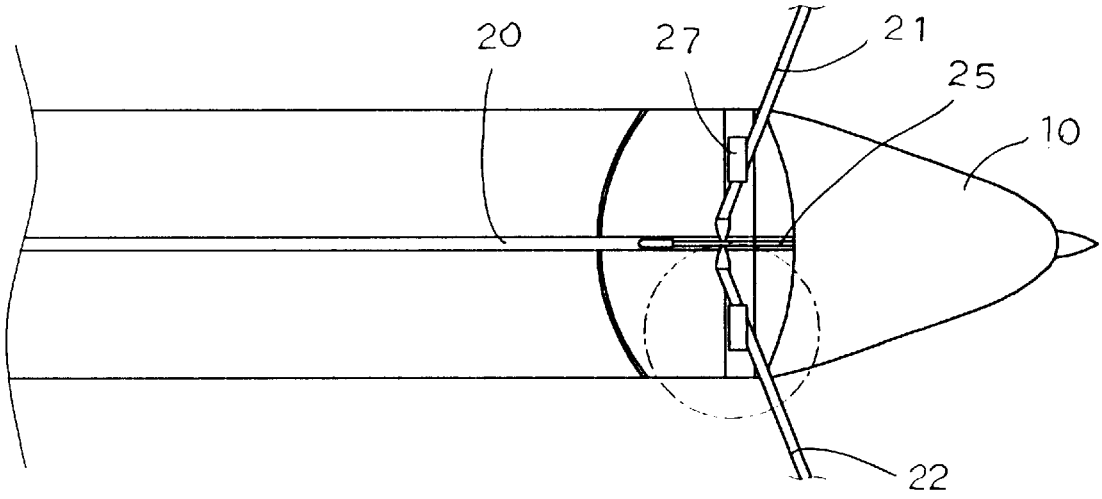
FIG. 3 is a partially perspective view of a kite of a preferred embodiment in accordance with the present invention.
Figure 3A:
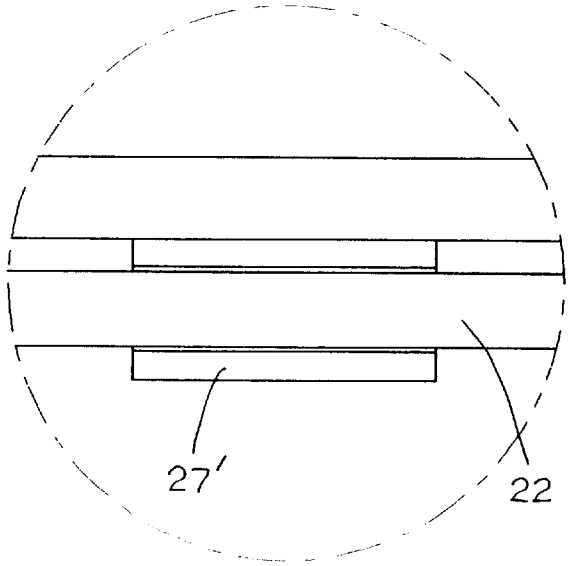
FIG. 3A is a schematic view illustrating a positioning block is disposed on a front rod of a preferred embodiment in accordance with the present invention.
Figure 4:
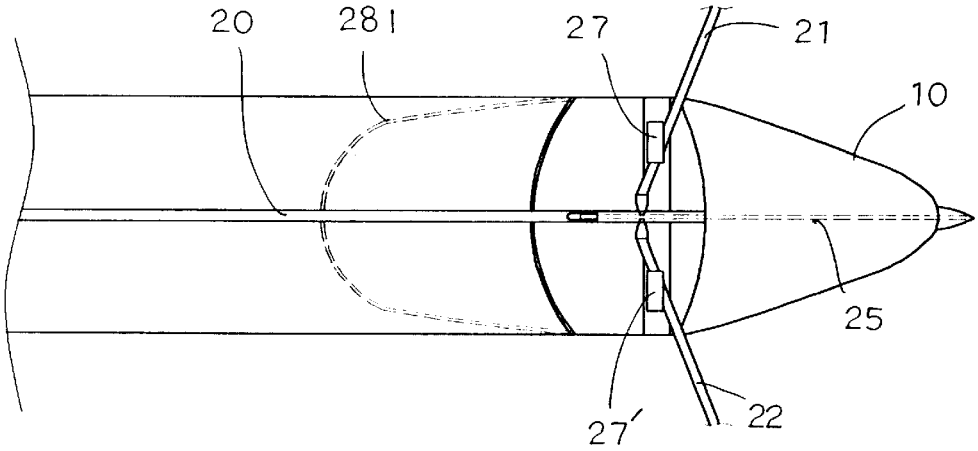
FIG. 4 is a partially top plan view of a kite of a preferred embodiment in accordance with the present invention.
Figure 5:
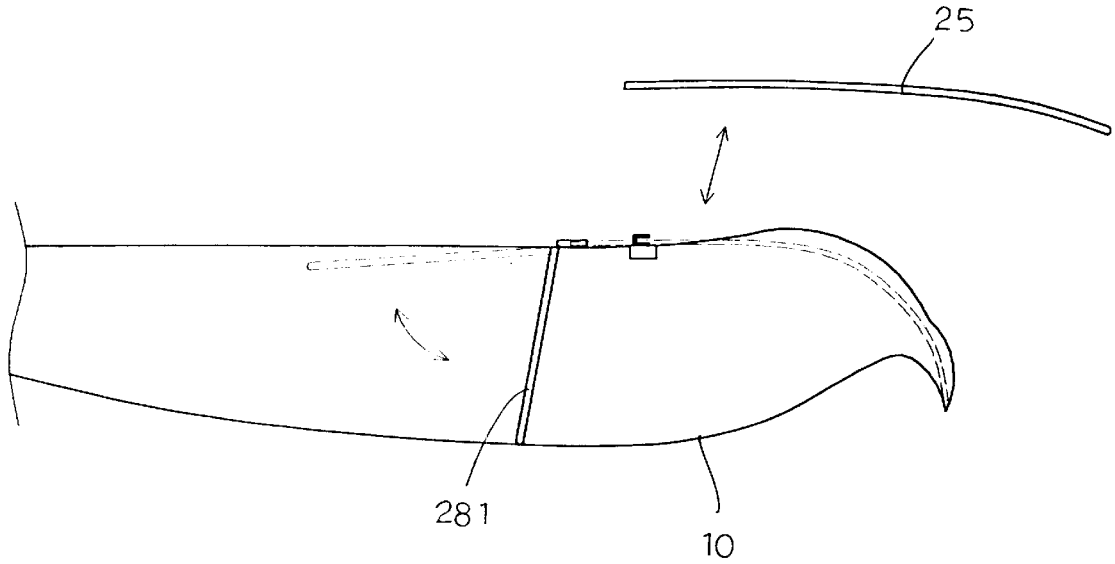
FIG. 5 is a partially elevational view of a kite of a preferred embodiment in accordance with the present invention.
Figure 6:
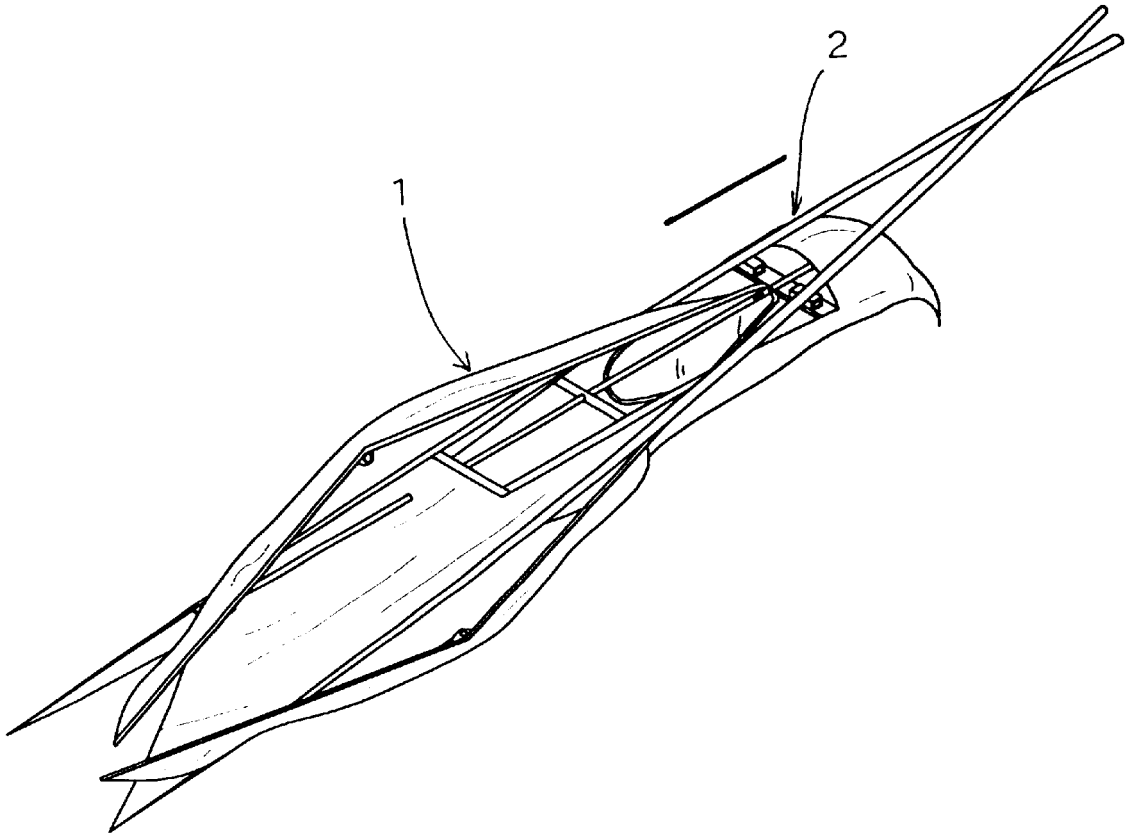
FIG. 6 is a schematic view illustrating an application of a kite of a preferred embodiment in accordance with the present invention.

Referring to FIGS. 1 to 6, a kite comprises a waterproof fabric 1 such as a tarpaulin and a waterproof canvas, and a support frame 2.

The support frame 2 has a levelling rod 29, a center spine 20 passing through the levelling rod 29, a head rod 25 disposed on a front of the center spine 20, a hollow joint 26 disposed on the center spine 20, a first front rod 21 connected to the hollow joint 26, a second front rod 22 connected to the hollow joint 26, a first positioning block 27 disposed on the hollow joint 26 to position the first front rod 21, a second positioning block 27' disposed on the hollow joint 26 to position the second front rod 22, a first connector 211 disposed on the first front rod 21, a second connector 221 disposed on the second front rod 22, a first extended bar 23 connected to the first connector 211, a second extended bar 24 connected to the second connector 221, a first connection rod 28 connected to the second extended bar 24 and the first front rod 21, a second connection rod 28' connected to the first extended bar 23 and the second front rod 22, the second extended bar 24 intersecting the first extended bar 23, and the levelling rod 29 disposed between the first connection rod 28 and the second connection rod 28'.

The waterproof fabric 1 has a head portion 10 covering the head rod 25, a first wing portion 11 supported by the first front rod 21 and the first connection rod 28, a second wing portion 11' supported by the second front rod 22 and the second connection rod 28', and a tail portion 12 supported by the first extended bar 23 and the second extended bar 24.

A curved rod 281 is connected to the first connection rod 28 and the second connection rod 28'.

The curved rod 281 reinforces the kite.

Referring to FIG. 6 again, the first extended bar 23 and the second extended bar 24 are detached.

The first front rod 21 disengages from the first positioning block 27 in order to be folded.

The second front rod 22 disengages from the second positioning block 27' in order to be folded.

It is easy to assembly the kite of the present invention. It is easy to detach the kite of the present invention also.

The present invention is not limited to the above embodiments but various modification thereof may be made. Furthermore, various changes in form and detail may be made without departing from the scope of the present invention.

I claim:

1. A kite comprises:

a support frame having a levelling rod, a center spine passing through the levelling rod, a head rod disposed on a front of the center spine, a hollow joint disposed on the center spine, a first front rod connected to the hollow joint, a second front rod connected to the hollow joint, a first positioning block disposed on the hollow joint to position the first front rod, a second positioning block disposed on the hollow joint to position the second front rod, a first connector disposed on the first front rod, a second connector disposed on the second front rod, a first extended bar connected to the first connector, a second extended bar connected to the second connector, a first connection rod connected to the second extended bar and the first front rod, a second connection rod connected to the first extended bar and the second front rod, the second extended bar intersecting the first extended bar, and the levelling rod disposed between the first connection rod and the second connection rod, and a waterproof fabric having a head portion covering the head rod, a first wing portion supported by the first front rod and the first connection rod, a second wing portion supported by the second front rod and the second connection rod, and a tail portion supported by the first extended bar and the second extended bar.

2. The kite as claimed in claim 1, wherein a curved rod is connected to the first connection rod and the second connection rod.

* * * * *